US010738456B2

(12) United States Patent
Dinu

(10) Patent No.: US 10,738,456 B2
(45) Date of Patent: Aug. 11, 2020

(54) ROBUST DEVICE FOR SPREADING SAND AT PREDETERMINED DIMENSIONS AND FOR PLACING DUCTS IN A SEWERAGE CHANNEL

(71) Applicant: Sorin Dinu, Judetul Dambovita (RO)

(72) Inventor: Sorin Dinu, Judetul Dambovita (RO)

( * ) Notice: Subject to any disclaimer, the term of this patent is extended or adjusted under 35 U.S.C. 154(b) by 0 days.

(21) Appl. No.: 15/543,694

(22) PCT Filed: Jan. 13, 2016

(86) PCT No.: PCT/RO2016/000004
§ 371 (c)(1),
(2) Date: Jul. 14, 2017

(87) PCT Pub. No.: WO2016/114679
PCT Pub. Date: Jul. 21, 2016

(65) Prior Publication Data

US 2017/0370089 A1 Dec. 28, 2017

(30) Foreign Application Priority Data

Jan. 14, 2015 (RO) ..... U 2015 00004

(51) Int. Cl.

| | |
|---|---|
| ***E03F 3/06*** | (2006.01) |
| ***E02F 3/84*** | (2006.01) |
| ***E02F 5/10*** | (2006.01) |
| ***E02F 5/12*** | (2006.01) |
| ***E02F 3/76*** | (2006.01) |

(52) U.S. Cl.
CPC ..... *E03F 3/06* (2013.01); *E02F 3/76* (2013.01); *E02F 3/847* (2013.01); *E02F 5/10* (2013.01); *E02F 5/12* (2013.01)

(58) Field of Classification Search
CPC combination set(s) only.
See application file for complete search history.

(56) References Cited

U.S. PATENT DOCUMENTS 5,626,442 A * 5/1997 Boyer ..... B08B 9/0436 134/22.1

* cited by examiner

*Primary Examiner* — Kyle Armstrong
(74) *Attorney, Agent, or Firm* — Michael D. Eisenberg

(57) ABSTRACT

The application relates to a robust self-propelled device, having an oblong shape and a self-supporting housing (1) of the exoskeleton type, having attached a winch (10) and that is supported by a rail track (8), comprising active parts and supporting parts: a levelling blade (2) connected by means of swiveling rods (9) to the housing exoskeleton and in the top part thereof to a laser receiver (6) by a removable graduated rod (5), also in the rear part it is provided with an active device for placing ducts (3). The said device is operated by an actuating and control panel (7), mounted by means of a removable supporting rod (4). The said device serving to eliminate the need for the human presence in the sewerage channel, preventing the risk of accidents, increasing the construction rate, increasing the accuracy in laying the sand base and also placing the sewerage duct on the sand base.

1 Claim, 1 Drawing Sheet

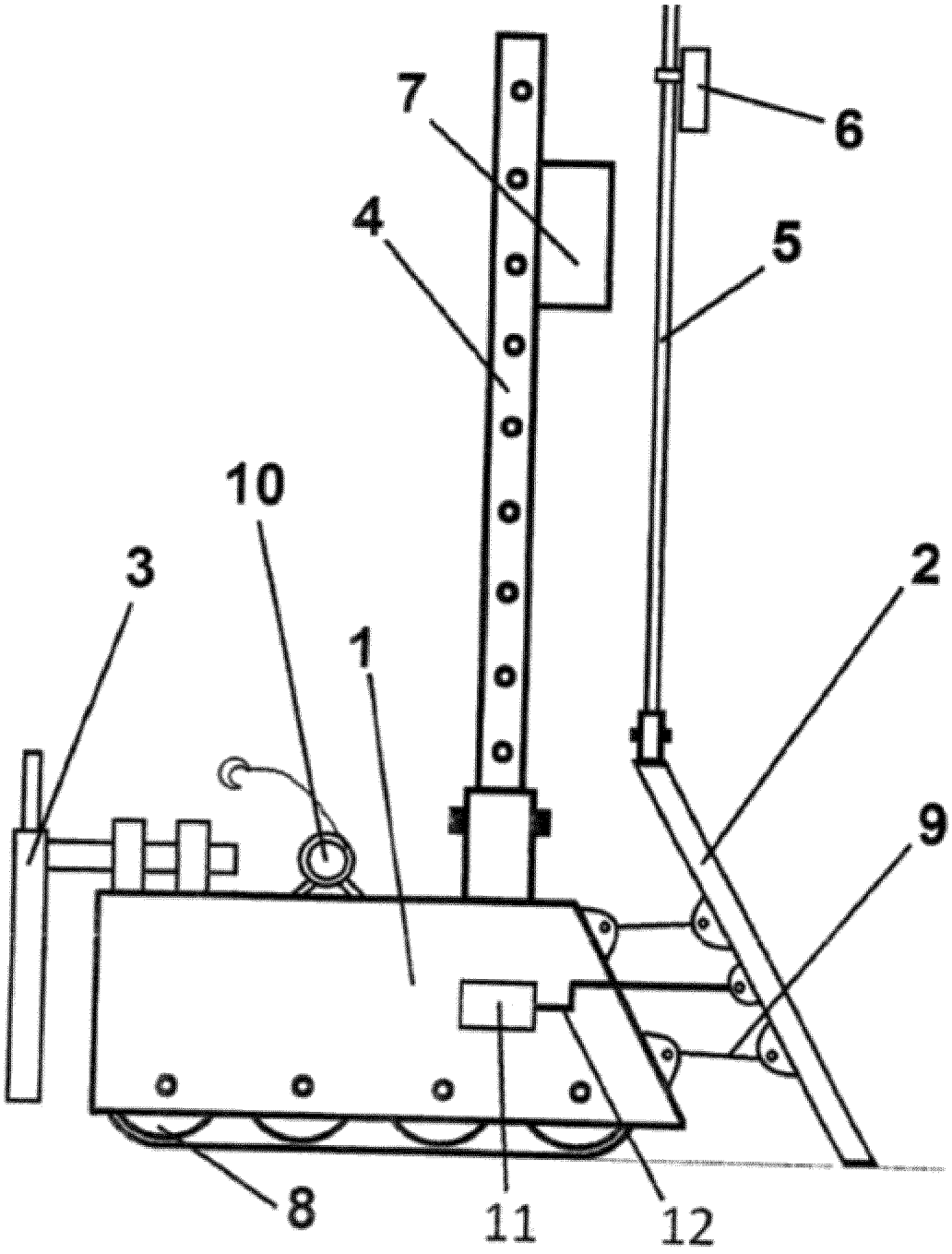
7
6
4
5
10
3
2
1
9
8
11
12

ROBUST DEVICE FOR SPREADING SAND AT PREDETERMINED DIMENSIONS AND FOR PLACING DUCTS IN A SEWERAGE CHANNEL

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

FIG. 1 is a schematic drawing illustrating a side view of a robust device for leveling sand and for mounting ducts in a sewerage channel, according to some embodiments of the present invention.

The figures are not intended to be exhaustive or to limit the invention to the precise form disclosed. It should be understood that the invention can be practiced with modification and alteration, and that the invention be limited only by the claims and the equivalents thereof.

DESCRIPTION OF THE INVENTION

The invention relates to a robust device for levelling sand at accurate dimensions and for mounting ducts in a sewerage channel.

The technical field for applying the invention is the sewerage channel constructions field, where the sand base must be laid with accurate linear dimensions, and according to the gravitational slope prescribed in the design, whereon the said ducts are mounted.

It is known that the process of sand levelling and mounting of the ducts in the sewerage channels is manually accomplished by the workers, being protected by metallic panels holding the channel walls, as it is required by the safety of work provisions.

The inventive features of the device according to the invention solve the following technical and safety of work problems:

- increases the accuracy of levelling the sand base in a channel;
- increases productivity;
- due to the fact that according to the present invention the worker is not required to enter into the sewerage channel in order to level the sand base and to mount the duct, there is no need of the metallic panels which are required as compulsory work safety means, and difficult to handle requiring significant efforts and time consuming for their fitting.

An embodiment of the device according to the invention is further described by way of example with reference to the accompanying drawing (FIG. 1) wherein a side view of the device according to the invention is presented.

According to the present invention there is provided a self-propelled robust device, having an oblong shape, with a self-supporting housing (1) of the exoskeleton type having attached a winch (10), the housing being supported by a rail track (8), that includes active and supporting parts in its structure: a levelling blade (2), connected by swiveling rods (9) to the housing exoskeleton, and connected at the top end thereof to a laser receiver (6) by a removable graduated rod (5) and at the rear part it is provided with an active device for mounting ducts (3). The said device is operated by an actuating and control panel (7), connected on a removable supporting rod (4). The role of the laser receiver is to confirm, by means of the laser beam, the position of the line that serves to guide the device according to the present invention. The said laser beam is generated by a laser emitter that indicates the predetermined dimensions according to the sewerage design.

The actuating and control panel (7) is able to start/stop and/or to operate the moving speed of the device according to the present invention. The control panel is also able to adjust the dimensions of the levelling blade (2). Specifically, a signal is transmitted from the actuating and control panel (7) to the electro-mechanical gear (11) which, in turn, adjusts the dimensions of the levelling blade (2) by lifting or lowering thereof, by means of a control rod (12) at a predetermined height.

The above mentioned active device for mounting ducts (3) has an oscillating move both in a vertical plane and in a horizontal plane, such as to mount the sewerage ducts within the sewerage channel.

What is claimed is:

1. A robust device for levelling sand at prescribed dimensions and for mounting ducts in a sewerage channel, comprising:

- a self-supporting housing having an exoskeleton,
- a means of movement supporting the self-supporting housing and configured to move the robust device;
- a levelling blade connected by swiveling rods to a front side of the self-supporting housing;
- a control rod joined to the levelling blade and to the self-supporting housing;
- an electro-mechanical gear joined to the self-supporting housing and configured to drive the control rod, controlling a position of the levelling a blade;
- a graduated rod removably joined to levelling blade and extending upward from the robust device;
- a laser receiver mounted on an upper portion of the graduated rod and configured to receive a guiding laser beam generated by an external laser emitter and to confirm that the device is in line with the guiding laser beam;
- a winch joined to the self-supporting housing;
- a movable device joined to a rear side of self-supporting housing, the movable device being configured to oscillate both vertically and horizontally, the movable device being configured for mounting together ducts located behind the device;
- a removable supporting rod joined to the self-supporting housing and extending upward from the self-supporting housing,
- an actuating and control panel mounted on the removable supporting rod above the self-supporting housing, the actuating and control panel being configured to be operated to:
  - generate a signal to the electromechanical gear to adjust the height of the levelling blade and;
  - control a motion of the robust device.

* * * * *